US007905745B2

(12) United States Patent
Watanabe et al.

(10) Patent No.: US 7,905,745 B2
(45) Date of Patent: Mar. 15, 2011

(54) CRIMPING TERMINAL WITH STRICTLY ADJUSTED CRIMPING FORCE

(75) Inventors: Jin Watanabe, Toyota (JP); Yoshihito Aoki, Toyota (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/654,057

(22) Filed: Dec. 9, 2009

(65) Prior Publication Data

US 2010/0144189 A1 Jun. 10, 2010

(30) Foreign Application Priority Data

Dec. 9, 2008 (JP) ..... 2008-313115

(51) Int. Cl.
*H01R 4/24* (2006.01)
*H01R 4/26* (2006.01)
*H01R 11/20* (2006.01)

(52) U.S. Cl. ..... 439/442; 439/877

(58) Field of Classification Search ..... 439/421, 439/442, 877, 878, 879, 880, 775
See application file for complete search history.

(56) References Cited

U.S. PATENT DOCUMENTS

| | | | | |
|---|---|---|---|---|
| 2,692,422 | A * | 10/1954 | Pierce | 29/865 |
| 3,955,044 | A * | 5/1976 | Hoffman et al. | 174/84 C |
| 7,008,274 | B2 * | 3/2006 | Hayashi et al. | 439/877 |
| 7,306,495 | B2 * | 12/2007 | Hashimoto et al. | 439/877 |
| 2005/0026515 | A1 | 2/2005 | Hashimoto et al. | |
| 2010/0035482 | A1 * | 2/2010 | Nakamura et al. | 439/775 |

FOREIGN PATENT DOCUMENTS

JP 2005-50736 2/2005

* cited by examiner

*Primary Examiner* — Hae Moon Hyeon
(74) *Attorney, Agent, or Firm* — Edwards Angell Palmer & Dodge LLP

(57) ABSTRACT

A crimping terminal joined with an aluminum electric wire, in which when the crimping terminal is crimped to the wire, a conduct-purpose crimping portion and a wire-hold crimping portion are formed at a crimping portion of a wire barrel of the crimping terminal. The crimping portion of the wire barrel is formed so as a curvature thereof is projected upwardly in a direction of moving a crimping die and so as a crimp height increases and a compression ratio decreases towards an insulation barrel of the crimping terminal. The curvature is shaped to have a constant degree of curvature, and is shaped to form a quadratic curve as a result of strictly adjusting a crimping force.

4 Claims, 4 Drawing Sheets

CRIMPING TERMINAL WITH STRICTLY ADJUSTED CRIMPING FORCE

BACKGROUND OF THE INVENTION

1. Field of the Invention

The present invention relates to a crimping terminal, especially a crimping form of the terminal for crimping a wire barrel of a crimping terminal to a conductive core portion of an aluminum electric wire (an aluminum electric wire or an aluminum alloy electric wire).

2. Description of Related Art

Recently, use of an aluminum electric wire has been demanded for weight reduction and recycling purposes for an automobile and such. Compared to a conventional copper electric wire, the aluminum electric wire has lower mechanical strength and lower meltdown temperature. Also oxidization of the surface thereof is easily produced on respective twisted core wires constituting the aluminum electric wire. Therefore, constriction resistance is generated when electric current flows only in a specific core wire, which may cause a blowout of the wire or continuity or contact failure.

Japanese Patent Publication No. 2005-50736 (FIG. 9) discloses a technique, explained herein after, which can be employed to prevent above-described problems. FIG. 3 shows a conventional art disclosed therein, which shows a crimping terminal 1 for an aluminum electric wire 2 having a box-shaped electrical contact portion 3 and a wire connecting portion 4 continued from the electrical contact portion 3. The wire connecting portion 4 has an insulation barrel 6 and a wire barrel 8 (both shown in a crimped condition) to be crimped to a covered portion 5 and a conductive core portion 7 of the aluminum wire 2, respectively. When the wire barrel 8 is crimped to the conductive core portion 7, a conduct-purpose crimping portion 9 and a wire-hold crimping portion 10 are formed at a crimping portion of the wire barrel 8.

The conduct-purpose crimping portion 9 is provided in the vicinity of the electrical contact portion 3, and the wire-hold crimping portion 10 is provided near to the insulation barrel 6. The conduct-purpose crimping portion 9 is formed by a large crimping force (caulking force), so it breaks an oxidized surface of the aluminum electric wire 2, ensuring a sufficient conduction with the conductive core portion 7 of the aluminum electric wire 2. On the other hand, the wire-hold crimping portion 10 is formed with a smaller crimping force compared to that of the conduct-purpose crimping portion 9, thus it can hold the conductive core portion 7 of the aluminum electric wire 2 for a long period of time. Therefore, the wire barrel 8 is formed slant from the conduct-purpose crimping portion 9 to the wire-hold crimping portion 10 so as to make the crimp height increase from the conduct-purpose crimping portion 9 towards the insulation barrel 6, forming an inclination 11 which is inclined at a constant angle. Bell mouths 12 are formed at both longitudinal ends of the crimping portion including the conduct-purpose crimping portion 9 and the wire-hold crimping portion 10.

However, since the inclination 11 of the above-described conventional art is formed straight, the crimping force (compression ratio) is not strictly adjusted when crimped. Thus, it is ambiguous whether or not mechanical connection reliability of the crimping portion of the wire barrel is securely ensured. In fact, the above-described conventional art retains a problem regarding to ensuring the secure mechanical connection of the crimping portion of the wire barrel.

In view of above-described problem, an object of the present invention is to provide a crimping terminal formed so as to improve the mechanical connection reliability of the crimping portion of the wire barrel.

SUMMARY OF THE INVENTION

For achieving the above-described object, a crimping terminal according to claim 1 is a crimping terminal joined with an aluminum electric wire including a conductive core portion formed by a plurality of twisted core wires and a covered portion covering the conductive core portion, having: an insulation barrel crimped with the covered portion; a wire barrel crimped with the conductive core portion exposed by removing a predetermined length of the covered portion from an end of the aluminum electric wire; and a crimping portion formed at the wire barrel when the wire barrel is crimped to the conductive core portion of the aluminum electric wire, so as to form a conduct-purpose crimping portion and a wire-hold crimping portion at the crimping portion. The entire crimping portion or each of the conduct-purpose crimping portion and the wire-hold crimping portion is formed to a curved shape projecting upwardly or downwardly in a direction of moving a crimping die when viewing in a direction perpendicular both to the direction of moving the crimping die and a direction along a lengthwise of the aluminum electric wire so as to decrease a compression ratio and increase a crimp height toward the insulation barrel.

According to the present invention described above, by forming the crimping portion of the wire barrel so as the side view shape thereof is a curvature, the crimping force (compressed ratio) relative to the conductive core portion of the aluminum electric wire can be strictly adjusted. Thus, optimum crimping is achieved by adjusting a degree of the curvature and determining the shape of the curvature. As a result, the mechanical connection reliability of the crimping portion of the wire barrel can be improved.

For achieving the object, a crimping terminal according to claim 2 is the terminal as described above, where the curved shape has a variable curvature.

According to the present invention described above, by strictly adjusting the crimping force, the side view shape of the crimping portion becomes a curvature having a quadratic-curve-like shape. The quadratic-curve-like shape includes a parabolic curve, an ellipse-like curve, a Pareto curve of a Pareto chart or the like. Thus, optimum shape of curvature for crimping can be provided.

For achieving the object, a crimping terminal according to claim 3 is the terminal as described above, where the wire barrel comprises a bell mouth at longitudinal end of the wire barrel so as to be other than the crimping portion having the curved shape.

According to the present invention described above, for example when the curvature is projected (convex) in the crimping direction, the curvature of the crimping portion of the wire barrel can be defined as the curvature not including a naturally-formed curvature continuous to the bell mouth.

DETAILED DESCRIPTION OF THE PREFERRED EMBODIMENTS

Figure 1A:
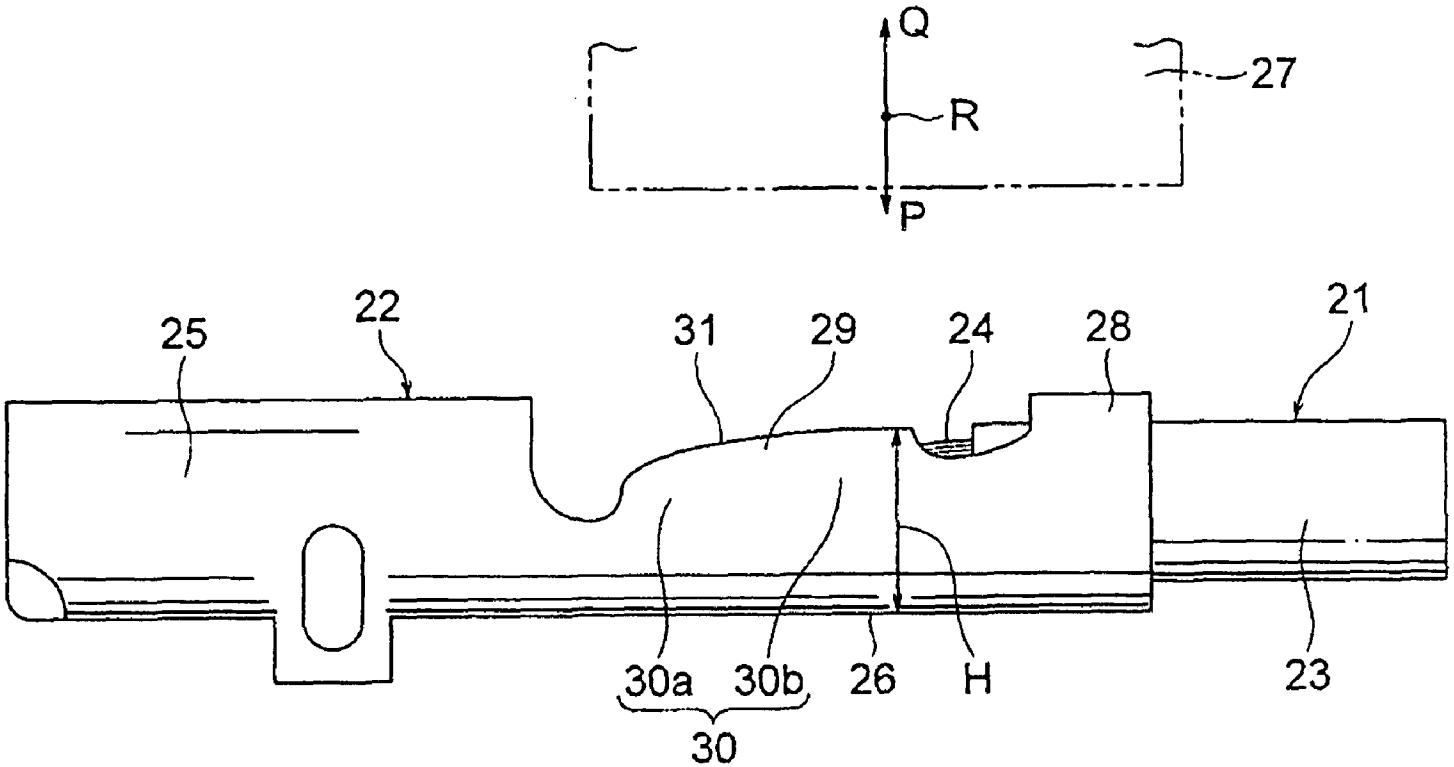
FIG. 1A is a side view of a crimping terminal according to a first embodiment of the present invention.
Figure 1B:
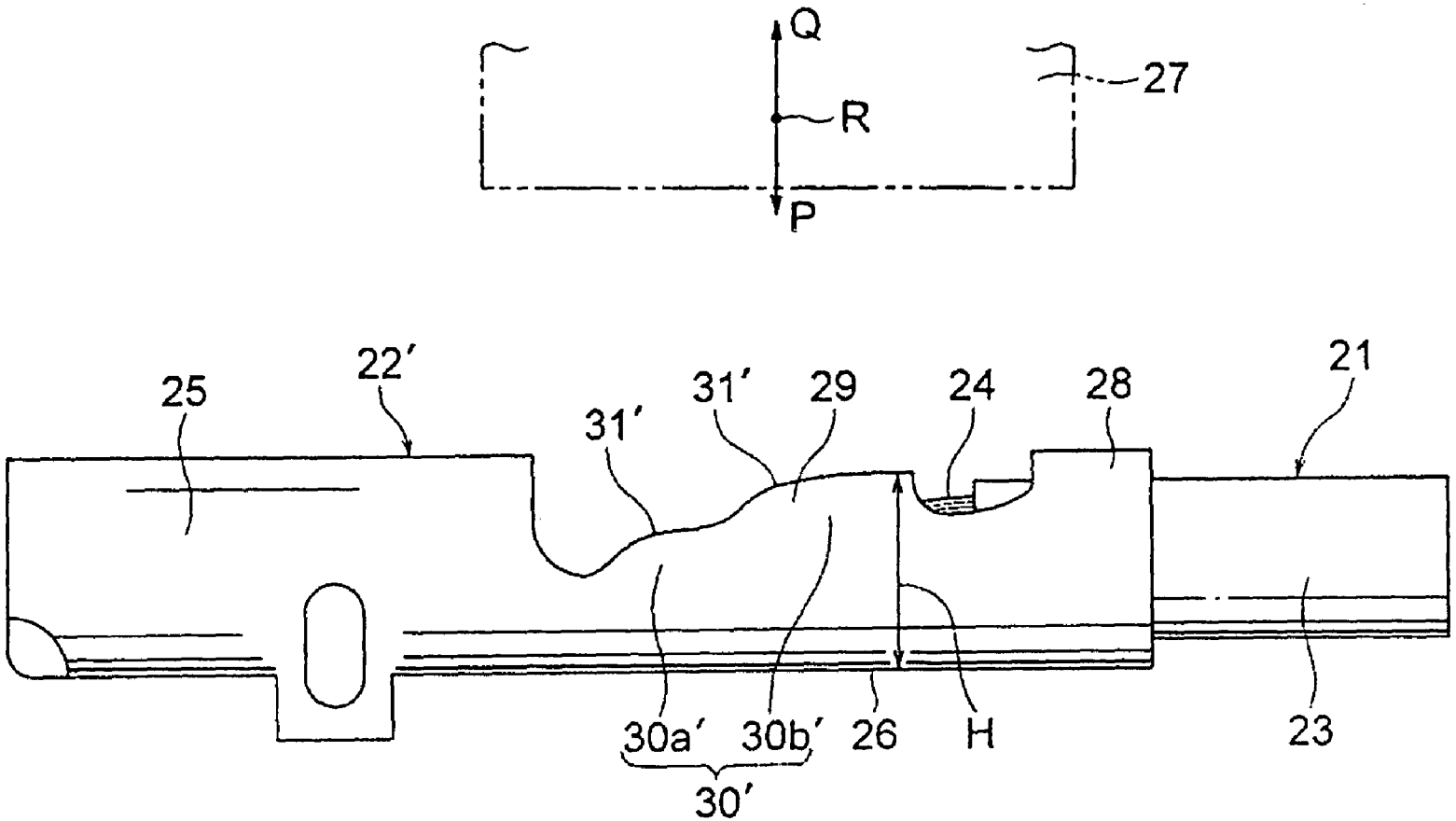
FIG. 1B is a side view of a crimping terminal according to a second embodiment of the present invention.

Embodiments of a crimping terminal according to the present invention will be explained hereinafter. FIG. 1A is a side view of a crimping terminal according to a first embodiment of the present invention and FIG. 1B is a side view of a crimping terminal according to a second embodiment of the present invention.

FIG. 1A shows an aluminum electric wire 21 and a crimping terminal 22. The aluminum electric wire 21, generally an aluminum wire or an aluminum alloy wire, has a plurality of twisted wires and a covered portion 23 covering the twisted wires. The aluminum wire 21 includes a conductive core portion 24 which is provided by removing a predetermined length of the covered portion 23 from an end of the aluminum wire 21. The conductive core portion 24 is provided at the twisted wires. The aluminum wire 21 is a known aluminum wire.

The crimping terminal 22 is manufactured by pressing a conductive metal plate, and is fixed to an end of the aluminum wire 21 by crimping. The crimping terminal 22 has an electrical contact portion 25 electrically contacting with a mating male terminal, and a wire connecting portion 26 continued from the electrical contact portion 25. Although the crimping terminal 22 according to the embodiment is female type, it is not limited to this configuration. The crimping terminal 22 is included as a part of a connector (not shown). The electrical contact portion 25 is box-shaped, as shown in FIG. 1, and one or plurality of elastic contact pieces which contact with the electrical contact portion of the mating terminal are provided thereinside.

A crimping die 27 moves in a direction indicated by an arrow with P to perform crimping, and then moves in a direction indicated by an arrow with Q to returns to its original position. The P direction corresponds to a "crimping direction", and the Q direction corresponds to a direction away from the crimping terminal (hereinafter called "leaving direction"). A direction indicated by a reference R, orthogonal to the crimping direction (P), the leaving direction (Q) and a longitudinal direction of the aluminum wire, i.e. a direction orthogonal to a page, corresponds to a direction viewing the crimping terminal 22 from its side.

The electrical contact portion 26 is a portion to be crimped to an end of the aluminum wire 21, and is provided with: an insulation barrel 28 (shown in a crimped condition) crimped to the covered portion 23 of the aluminum wire 21; and a wire barrel 29 (shown in a crimped condition) crimped to a conductive core portion 24 of the aluminum wire 21. Before crimping, the insulation barrel 28 is formed with a pair of band-shaped pieces. When the crimping die 27 moves in the crimping direction (P), the pair of band-shaped pieces of the insulation barrel 28 is bent and curled (or bent into an M-like shape) relative to the covered portion 23 of the aluminum wire 21, thereby crimping the insulation barrel 28 onto the covered portion 23 of the aluminum wire 21.

The wire barrel 29 is one of the significant features of the present invention. Before crimping, the wire barrel 29 is formed with a pair of band-shaped pieces having a wider width and a shorter length compared to that of the insulation barrel 28. When the crimping die 27 moves in the crimping direction (P), the pair of band-shaped pieces of the wire barrel 29 is bent and deformed into an M-like shape relative to the conductive core portion 24 of the aluminum wire 21, thereby crimping the wire barrel 29 onto the conductive core portion 24 of the aluminum wire 21. When the wire barrel 29 is crimped onto the conductive core portion 24 of the aluminum wire 21 as described above, a conduct-purpose crimping portion 30*a* and a wire-hold crimping portion 30*b* are formed at a crimping portion 30 of the wire barrel 29. The crimping portion 30 corresponds to an entire portion of the wire barrel 29 in a longitudinal direction thereof.

Figure 3:
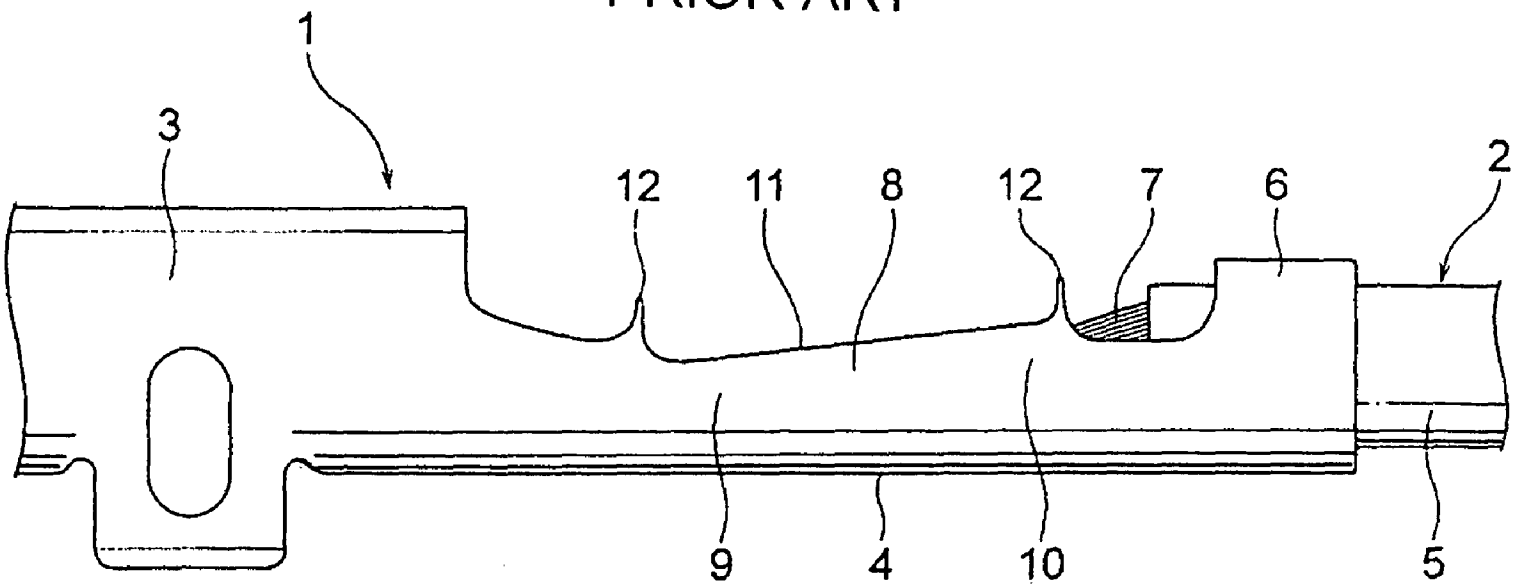
FIG. 3 PRIOR ART
FIG. 3 is a side view of a conventional crimping terminal.

The crimping portion 30 is curved so as a curvature 31 provided on the crimping portion 30 is convex in the leaving direction (Q direction) when viewed from side, or in another words is projected upwardly in the moving direction of the crimping die 27. The curvature 31 is shaped so as a crimp height H increases and the compression ratio decreases towards the insulation barrel 28. The curvature 31 is shaped to have constant degree of curvature and shaped to form a quadratic curve (for example a parabolic curve), as shown in FIG. 1A, as a result of strictly adjusting a crimping force. In the present invention, since the crimping portion 30 is shaped into the curvature 31 when viewed from side, a strict adjustment of the crimping force (the compression ratio) relative to the conductive core portion 24 of the aluminum wire 21 can be achieved, which cannot be achieved with the straight inclination 11 of the conventional art shown in FIG. 3. As a result, an optimum crimping is achieved. Thus, the mechanical connection reliability of the crimping portion 30 can be improved. In addition, a cross-sectional shape of the crimping portion 30 is a known shape where the wire barrel 29 can deform into an M-like shape.

FIG. 1B shows another embodiment of the invention. A crimping terminal 22' shown in FIG. 1B is similar to the crimping terminal 22 shown in FIG. 1A, only the shape of the crimping portion is different as shown by the crimping portion 30'. For the crimping portion 30', each of a conduct-purpose crimping portion 30*a'* and a wire-hold crimping portion 30*b'* is formed into a curvature 31'. Thus, the crimping force (the compression ratio) is adjusted within each of the conduct-purpose crimping portion 30*a'* and the wire-hold crimping portion 30*b'*. Each of the curvatures 31' is convex in the leaving direction (Q direction) when viewed from side. The each curvature 31' is shaped so as a crimp height H increases and the compression ratio decreases towards the insulation barrel 28. Therefore, the crimping terminal according to this embodiment shown in FIG. 1B can also improve the mechanical connection reliability of the crimping portion of the wire barrel.

The curvatures 31' of the conduct-purpose crimping portion 30*a'* and the wire-hold crimping portion 30*b'* are continuous with each other.

Figure 2:
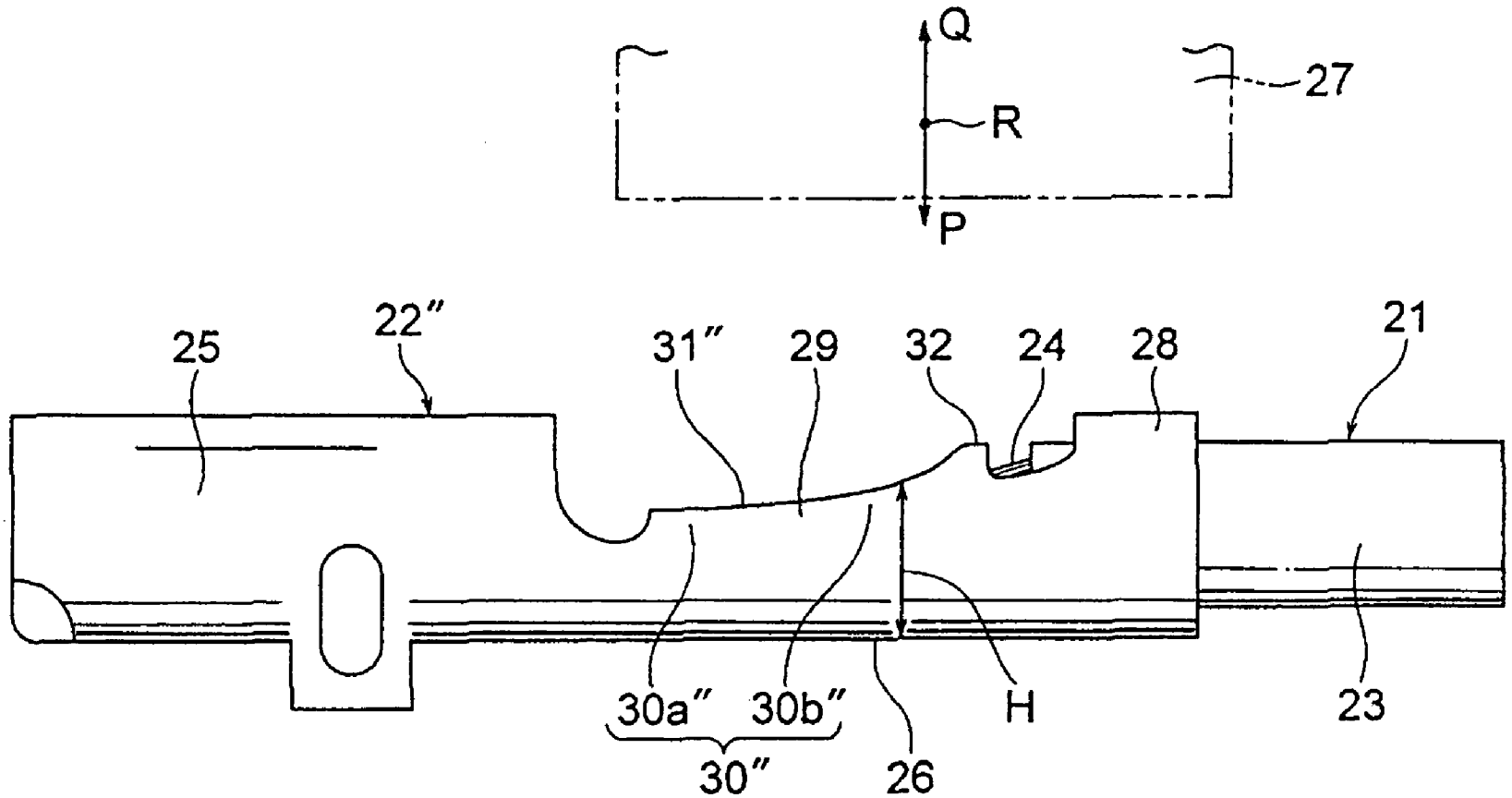
FIG. 2 is a side view of a crimping terminal according to a third embodiment of the present invention.

FIG. 2 shows another embodiment of the invention. A crimping terminal 22" shown in FIG. 2 is similar to the crimping terminal 22 shown in FIG. 1A, only the shape of the crimping portion is different as indicated by the numerical reference 30". The crimping portion 30" includes entire portion of the wire barrel 29 in a longitudinal direction thereof. A bell mouth 32 may arbitrary be provided at an end portion of the wire barrel 29 which is not included within the crimping portion 30". The crimping portion 30" has a conduct-purpose crimping portion 30*a"* and a wire-hold crimping portion 30*b"*. Also, the crimping portion 30" is formed into a curvature 31" which is convex in the crimping direction (P direction) when viewed from side. The curvature 31" is shaped so as a crimp height H increases and the compression ratio decreases towards the insulation barrel 28. The curvature 31" has a constant degree of curvature as a result of strictly adjusting a crimping force, and is shaped to form a quadratic curve (for example a parabolic curve which is curved inversely of the one shown in FIG. 1A), as shown in FIG. 2.

Therefore, the crimping terminal according to this embodiment, shown in FIG. 2, can also improve the mechanical connection reliability of the crimping portion of the wire barrel.

The embodiments described herein only indicate the representative embodiments, and the present invention is not limited to those embodiments. Various modifications and variations can be made within the scope of the invention described herein.

What is claimed is:

1. A crimping terminal joined with an aluminum electric wire including a conductive core portion formed by a plurality of twisted core wires and a covered portion covering the conductive core portion, comprising:

an insulation barrel crimped with the covered portion;

a wire barrel crimped with the conductive core portion exposed by removing a predetermined length of the covered portion from an end of the aluminum electric wire; and a crimping portion formed at the wire barrel when the wire barrel is crimped to the conductive core portion of the aluminum electric wire, so as to form a conduct-purpose crimping portion and a wire-hold crimping portion at the crimping portion, wherein the entire crimping portion of the wire barrel has a continuous curved shape, or each of the conduct-purpose crimping portion and the wire-hold crimping portion of the wire barrel has a curved shape which is continuous, the curved shape projecting upwardly or downwardly in a direction of moving a crimping die when viewing in a direction perpendicular both to the direction of moving the crimping die and a direction along a lengthwise of the aluminum electric wire so as to increase a crimp height toward the insulation barrel, thereby strictly adjusting a crimping force at the crimping portion.

2. The crimping terminal as claimed in claim 1, wherein the curved shape has a variable curvature.

3. The crimping terminal as claimed in claim 1, wherein the wire barrel comprises a bell mouth at an end portion of the wire barrel so as to be other than the crimping portion having the curved shape.

4. The crimping terminal as claimed in claim 2, wherein the wire barrel comprises a bell mouth at an end portion of the wire barrel so as to be other than the crimping portion having the curved shape.

* * * * *